United States Patent [19]

Muir

[11] 4,441,287

[45] Apr. 10, 1984

[54] FRAMED BUILDING CONSTRUCTION

[75] Inventor: William Muir, Nedlands, Australia

[73] Assignee: Engineered Roof Trusses Pty. Ltd., Welshpool, Australia

[21] Appl. No.: 286,044

[22] Filed: Jul. 22, 1981

[30] Foreign Application Priority Data

| | | | |
|---|---|---|---|
| Jul. 24, 1980 | [AU] | Australia | PE4675 |
| Nov. 11, 1980 | [AU] | Australia | PE6349 |
| Sep. 2, 1981 | [AU] | Australia | PE7999 |

[51] Int. Cl.[3] ..... E04B 7/02; E04C 3/36

[52] U.S. Cl. ..... 52/93; 52/639; 52/642; 52/721

[58] Field of Search ..... 52/93, 90, 639, 200, 52/642, 721

[56] References Cited

U.S. PATENT DOCUMENTS

| | | | |
|---|---|---|---|
| 624,857 | 5/1899 | Pease | 52/639 |
| 1,187,145 | 6/1916 | Henning | 52/18 |
| 1,724,577 | 8/1929 | Gritzner | 52/93 |
| 2,967,332 | 1/1961 | Donlin | 52/93 |
| 3,008,195 | 11/1961 | Coffey | 52/93 |
| 4,005,556 | 2/1977 | Tuomi | 52/93 |
| 4,285,176 | 8/1981 | Runkle | 52/93 |
| 4,317,316 | 3/1982 | Atwood et al. | 52/93 |

FOREIGN PATENT DOCUMENTS

| | | | |
|---|---|---|---|
| 1030371 | 3/1953 | France | 52/86 |

*Primary Examiner*—Alfred C. Perham

*Attorney, Agent, or Firm*—Harness, Dickey & Pierce

[57] ABSTRACT

Building construction comprising a plurality of pairs of upstanding posts each post of each pair being mounted in opposed relation to the other post of the pair, said posts supporting a roof structure comprising a set of parallel beams, wherein each beam interconnects a pair of posts and each beam being mounted to one side of the respective posts, each post having a transversely extending strut fixed to the upper end of the post and supported by a brace extending between said strut and an intermediate point of said post, said strut being located in parallel relationship to said beams and being fixed thereto.

16 Claims, 6 Drawing Figures

FRAMED BUILDING CONSTRUCTION

Figure 1:
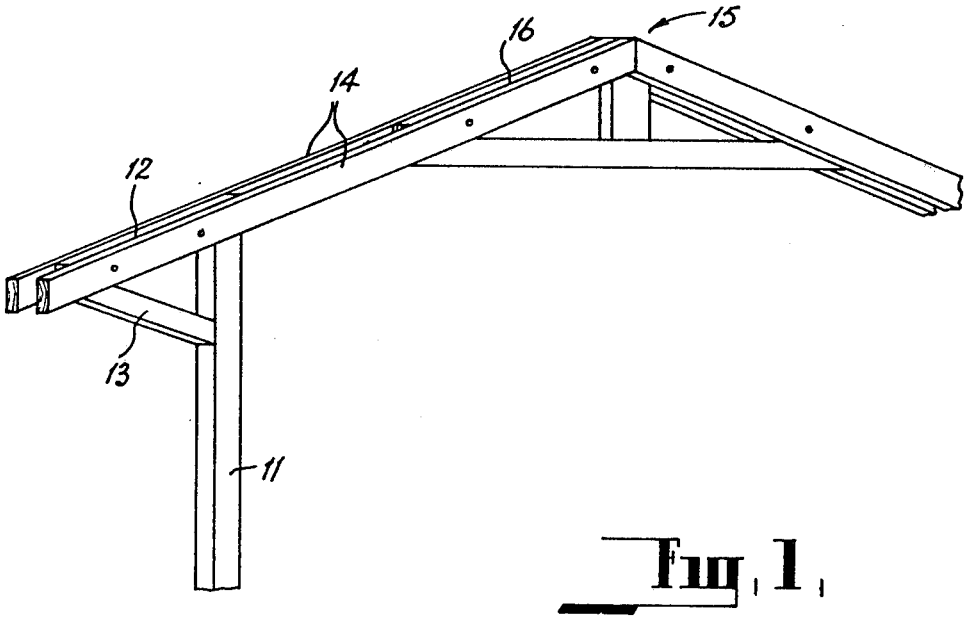

This invention relates to building construction.

In one form the invention relates to "pole barn" type buildings which comprise a set of vertical support posts located along the walls at least and supporting a roof structure between them. Previously, such structures have involved at least two parallel sets of spaced vertical support posts which support conventional roof trusses, which in turn support the roof. Where large distances are to be spanned by the trusses they usually must be supported at intermediate locations by further upstanding posts. As a result the floor space of the building becomes cluttered with support posts and the usable height within the building depends directly on the height of the posts used since any space above the level of the posts is occupied by truss members. In such structures the roof trusses accommodate the various loadings produced by the roof while the posts essentially support the weight of the roof trusses and cladding.

It is an object of this invention to provide a moment resisting interconnection between the support posts and roof structure of a building to accommodate some of the forces applied to the roof structure of the building.

In one form the invention resides in a building construction comprising a plurality of pairs of upstanding posts each pair of posts being mounted in opposed relation to each other, said posts supporting a roof structure comprising a set of parallel beams, wherein each beam interconnects a pair of posts and each beam being mounted to one side of the respective posts, each post comprising a transversely extending strut fixed to the upper end of the post and supported by a brace extending between said strut and an intermediate point of said post, said strut being located in parallel relationship to said beams and being fixed thereto.

According to a preferred feature of the invention, a pair of beams are mounted in parallel relationship between the pair of posts and are fixed in opposed relation to each post and its strut.

According to a preferred feature of the invention of said beam comprises two portions wherein each portion extends upwardly from its corresponding post and said portions are interconnected at their upper end.

According to a preferred feature of the preceding feature the interconnection of said upper ends incorporates a gusset member fixed to said beams at said upper ends.

According to a further preferred feature of the above invention each end portion of each beam has; a downwardly depending leg mounted thereto, said leg being parallel to and fixed to the post; and a diagonal member between the beam and the leg which is parallel to and is fixed to the respective brace.

According to a further preferred feature of the invention each beam is fixed between a pair of said posts and the struts thereof.

In one form the invention resides in a building contruction comprising a plurality of pairs of upstanding posts, the posts of each pair being mounted in opposed relation to each other, said posts supporting a roof structure comprising a beam interconnecting a pair of posts said beam being mounted to one side of the post, each post having a transversely extending strut fixed to its upper end and a brace between the strut and the post, said strut being parallel and fixed to said beam, each end portion of said beam having a downwardly depending leg fixed thereto and a diagonal between the leg and the beam said leg being parallel to and fixed to said post and said diagonal being parallel and fixed to said brace.

According to a preferred feature of the above invention there are two beams located to each side of a pair of opposed posts.

According to a preferred feature of the preceding form of the invention the beams comprise two portions wherein each portion extends upwardly from its corresponding post and said portions are interconnected at their upper ends.

According to a preferred feature of the preceding form of the invention a pair of posts are fixed to each side of the beam at each end thereof.

According to a preferred feature of the preceding form of the invention a plurality of beams are located in parallel spaced relation having their ends supported by posts located between the beams.

The invention will be more fully understood in the light of the following description of several specific embodiments. The description is made with references to the accompanying drawings of which;

FIGS. 1, 2, 3, 4, 5 and 6 are schematic oblique views of the interconnection between a post and associated beam according to a first, second, third and fourth embodiment respectively.

Each of the embodiments is directed to "pole barns" or like structures where a roof is supported between two parallel sets of spaced posts.

The first embodiment is a framed building construction which comprises a set of posts mounted vertically in the ground in spaced relation along each side of the building in opposed pairs, with a roof structure mounted between the upper ends of said posts 11. Each post supports at its upper end an outwardly extending strut 12 which is also supported from the post by means of a brace 13 interconnecting the free end of the strut 12 with the post 11 at a point based downwardly from the upper end. The roof structure comprises a pair of beams 14 associated with each pair of posts 11 which extend across the space therebetween. In the case of the first embodiment, the beams comprise two portions each of which are affixed to the posts 11 towards one end and extend upwardly therefrom such that their upper ends are interconnected in order to form a ridge 15. The interconnection of the portions at their upper end is facilitated by a triangular gusset frame 16 which is located between each of the beams 14 and is fixed at spaced intervals to the beams. The beams 14 at their outer end are mounted to opposed sides of the post 11, in parallel abutting relationship with the strut 12 of the post and are affixed to the strut 12 at spaced locations along its length.

As a result of the first embodiment a moment resisting interconnection is provided between the beams 14 of the roofing structure and the posts 11 of the building. Such moment resisting action is facilitated by means of the strut 12 and brace 13 which are provided on the post 11 before installation. As a result of this moment resisting interconnection the span available for the roofing structure is increased without the need to provide further supporting frame work below the beams from that conventionally available in framed building constructions. This serves to increase the height of the space available with the building and eliminate the need for intermediate support posts.

Figure 2:
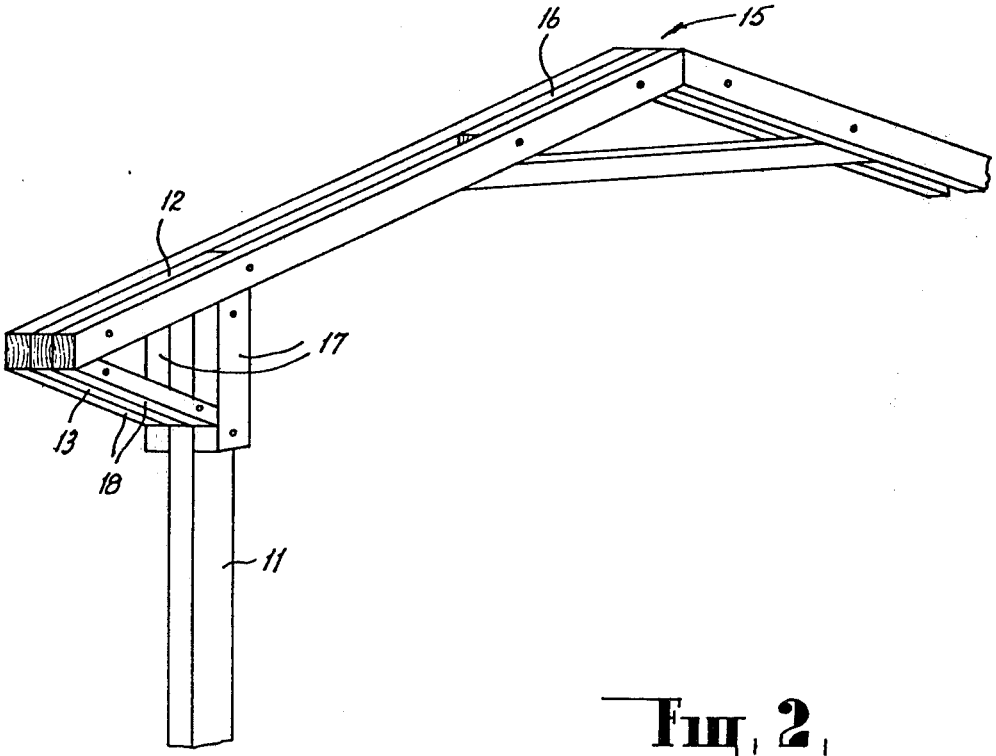

The second embodiment of FIG. 2 takes a similar form of the building construction of the first embodiment of FIG. 1 and therefore corresponding components have been given the same reference numerals. The second embodiment differs from the first embodiment in that each end portion of each of the beams 14 have a downwardly depending leg 17 formed thereon and a diagonal member 18 is mounted between the leg 17 and the beam 14 such that it is parallel with the brace 13 of the post when the beams are in position on the post. On the beams being mounted to the post the legs 17 are fixed to each side of the post 11 and the diagonals are fixed to each side of the brace 13.

Figure 3:
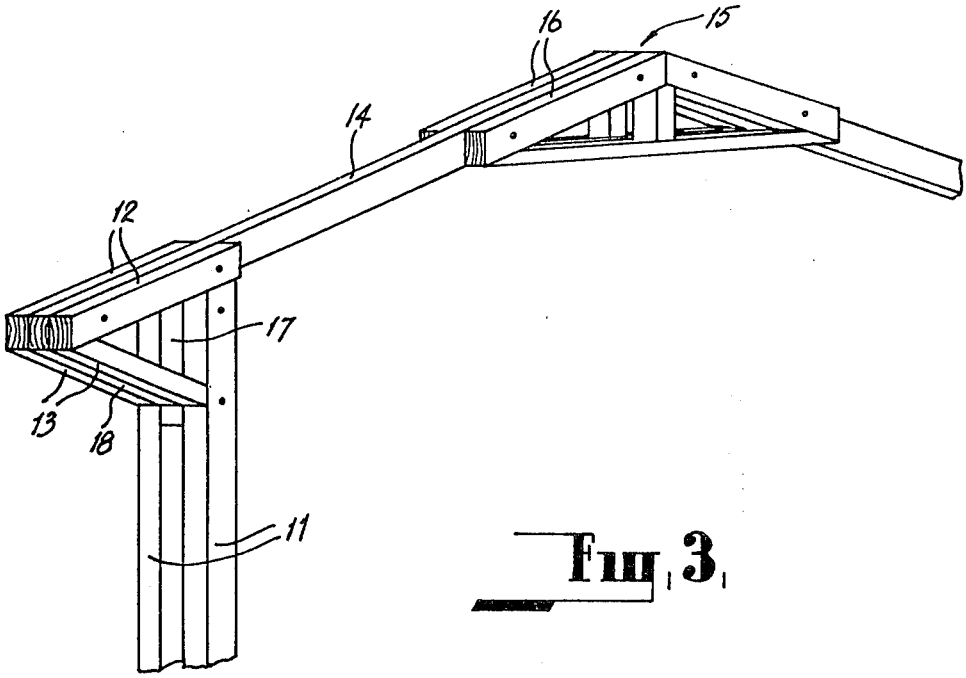

The third embodiment of FIG. 3 takes a similar form to that of the second embodiment of FIG. 2 and corresponding components have been given the same reference numerals. In the case of the third embodiment a single beam 14 is located at each end between the struts 12 of a pair of posts 11 while the leg 17 of the beam is located and fixed between the posts 11 and the diagonal member 18 is located and fixed between the braces 13 of the posts 11. In addition the junction between each portion of the beam at the ridge 15 therein is supported between a pair of preformed triangular gusset frames 16.

Figure 4:
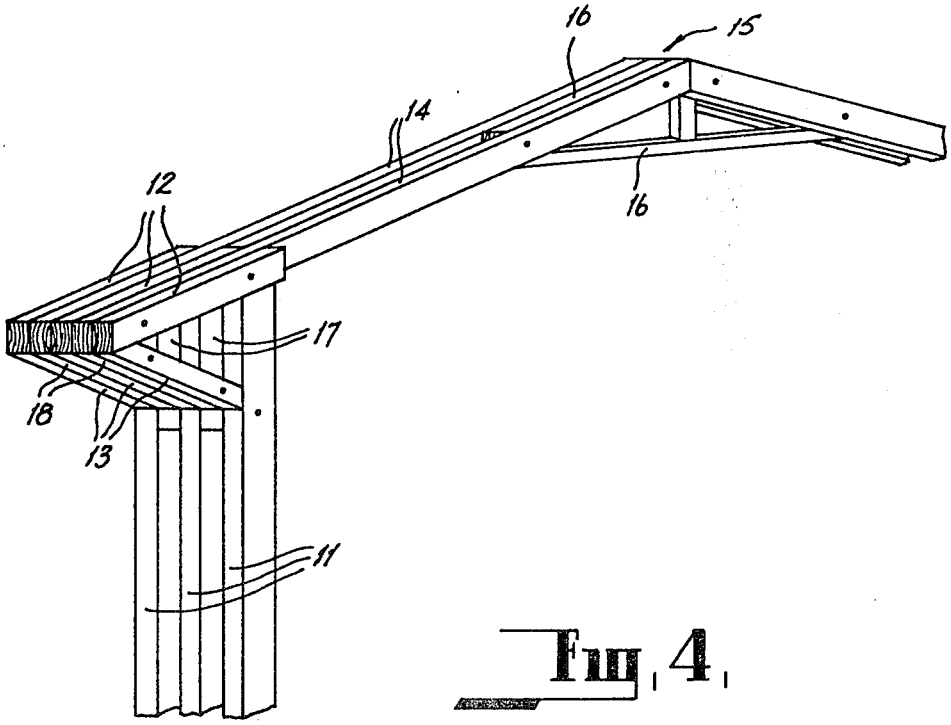

The fourth embodiment of FIG. 4 is similar to the second and third embodiments and therefore corresponding components have been given the same numerals. The fourth embodiment comprises a combination of the second and third embodiment whereby the end of the beams 14 of the second embodiment of FIG. 2 are fixed between a pair of posts 11 in addition to the central post 11 between the beams.

Figure 5:
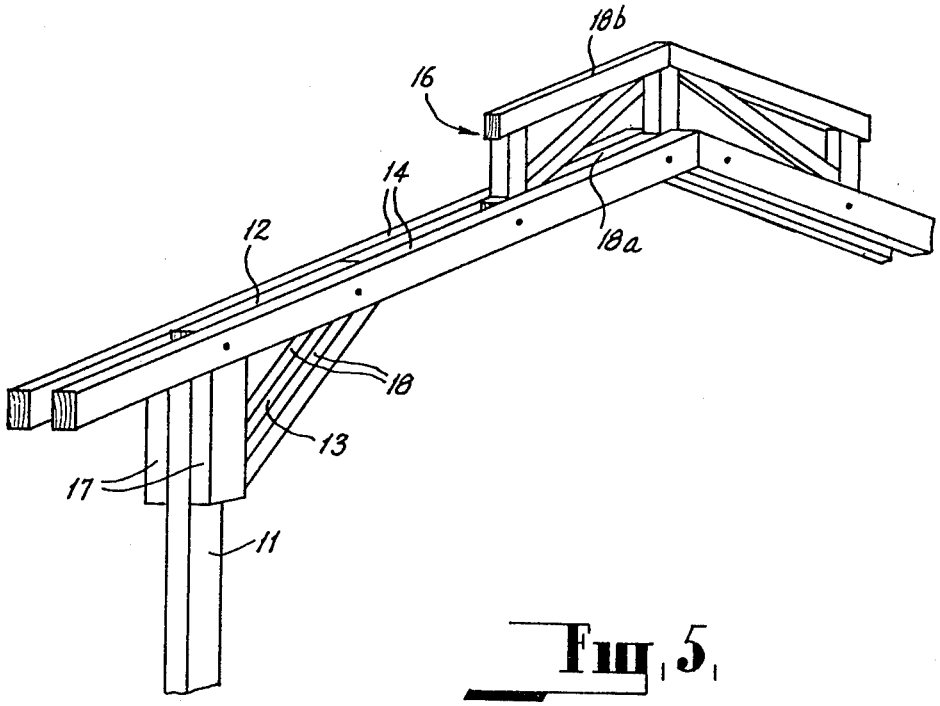
Figure 6:
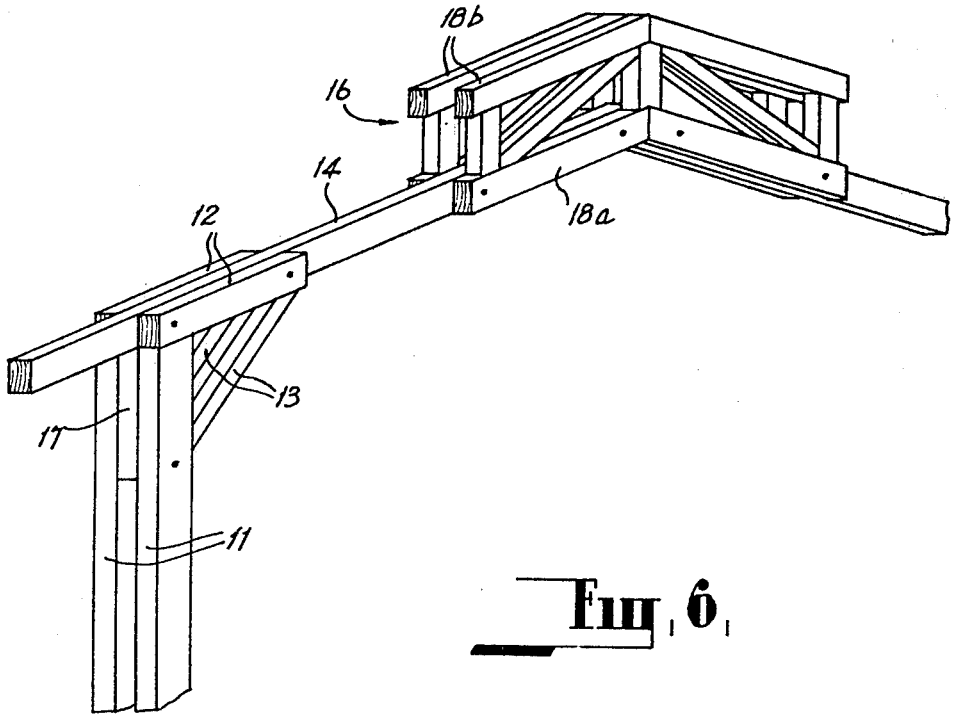

The fifth and sixth embodiments of FIGS. 5 and 6 respectively correspond to the second and third embodiment respectively except in relation to the shape of the gusset frames 16. Each gusset frame 16 comprises a pair of parallel beams 18*a* and *b* which bridge the ridge of the roof with one beam 18*a* located between or on either side respectively of the main beams or beam 14 with the other beam 18*b* of the gusset frame 16 located above the main roof line. The function of the gusset frame of the fifth and sixth embodiments is to enable the incorporation of skylights and/or venting into the roof structure. In addition, in each embodiment the struts 12 and braces 13 mounted to each post are located on the inner face of the posts 11.

As a result of each of the embodiments, buildings of the pole barn type can be constructed utilising a greater span than is normally available utilising conventional roof trusses without the need for the use of intermediate supports and at the same time leaving more of the space below the roof available for use.

It should be appreciated that the duplication of beams, posts and gusset frames may vary in accordance with the span over which the beams are to extend and/or the anticipated loading to be carried by the beams. In addition the nature of the gusset frames may vary in complexity with the loading which is to be placed on the junction of the two portions of the beam. Furthermore the beam need not be restricted to one comprising two portions only but may be of a unitary form or may comprise several interconnected portions.

It should be appreciated that the scope of the present invention need not be restricted to the particular scope of the embodiments described above and in particular the configuration of the posts and their associated struts need not take the form as that discussed in the embodiment since the strut may be mounted on the interior side of the post such that it forms an obtuse angle with the post. Similarly the diagonal may be located to either side of the downwardly depending leg of the beam irrespective of the location of the strut.

It should also be appreciated that the invention may be used in the construction of any form of building having any desired purpose.

I claim:

1. Building construction comprising a plurality of pairs of upstanding posts, each pair of posts being mounted in opposed relation to each other, said pairs of posts supporting a roof structure comprising sets of parallel beams, wherein each beam extends between a respective pair of posts and is mounted to one side thereof, each post comprising a subassembly comprising a vertically extending member, a transversely extending strut directly fixed to the upper end of said vertically extending member and supported by a brace extending diagonally between said strut and an intermediate point of said vertically extending member and directly affixed to said strut and said vertically extending member to form a triangular reinforced area, said strut being located in parallel relationship to the respective beam and being fixed thereto.

2. A building construction as claimed at claim 1 wherein a pair of beams are mounted in parallel relationship between the respective pair of posts and are fixed in opposed relation to each post and its strut.

3. A building construction as claimed at claim 2 wherein each beam comprises two portions each extending upwardly from its respective post and said portions being interconnected at their upper end.

4. A building construction as claimed at claim 3 wherein the interconnection of said upper ends of the beam portions further includes a gusset member fixed to said beam portions at said upper ends.

5. A building construction as claimed at claim 2 wherein each beam has a downwardly depending leg mounted thereto, said leg being parallel to and fixed to the respective post and a diagonal member extending between the beam and the leg and which is parallel to and is fixed to the respective brace.

6. A building construction as claimed at claim 1 wherein each beam is fixed to and positioned between a pair of said posts and the struts thereof.

7. A building construction as claimed at claim 4 wherein each gusset member is triangular in shape.

8. A building construction as claimed at claim 4 wherein each gusset member comprises a gusset frame including two parallel beams bridging the interconnection of the beam portions wherein one beam of said gusset frame is located above the interconnection of said portions and the other beam of said gusset frame lies beside said interconnection of said beam portions.

9. A building construction comprising a plurality of pairs of upstanding posts, the posts of each pair being mounted in opposed relation to each other, said pairs of posts supporting a roof structure comprising a beam interconnecting a respective pair of posts said beam being mounted to one side of the posts of said pair, each post of said pair comprising a subassembly consisting of a vertically extending member, a transversely extending strut directly fixed to its upper end and a brace extending between and directly affixed to said strut and the respective vertically extending member, said strut being parallel and fixed to said beam, each end portion of said beam having a downwardly depending leg fixed thereto and a diagonal extending between the leg and the beam said leg being parallel to and fixed to the respective post and said diagonal being parallel and fixed to said brace.

10. A building construction as claimed at claim 9 wherein there are two beams each located to a respective side of the pair of posts.

11. A building construction as claimed at claim 10 wherein the beams comprise two portions and each beam portion extending upwardly from its corresponding post, said beam portions being interconnected at their upper ends.

12. A building construction as claimed at claim 9 wherein a pair of posts are fixed to each side of the beam at each end thereof.

13. A building construction as claimed at claim 9 wherein a plurality of beams are located in parallel spaced relation each of said beams having their respective ends supported by a respective post located between the beams.

14. A building construction as claimed at claim 11 wherein the interconnection of the upper ends of the beam portions incorporates a gusset member fixed to said beams at said upper ends.

15. A building construction as set forth in claim 11 wherein the interconnection between the upper ends of the beam portions includes a gusset frame, said gusset frame being triangular in shape.

16. A building construction as set forth in claim 11 wherein the interconnection between the beam portion upper ends includes a gusset frame comprising two parallel beams bridging the interconnection between said beam portions, one beam of said gusset frame being located above the interconnection of said beam portions, the other beam of said gusset frame lying beside said beam end portions and being affixed thereto.

* * * * *